United States Patent [19]

Davis

[11] 4,324,116

[45] Apr. 13, 1982

[54] TWIN BELT VACUUM WASHER

[75] Inventor: Steven S. Davis, Bountiful, Utah

[73] Assignee: Envirotech Corporation, Menlo Park, Calif.

[21] Appl. No.: 141,865

[22] Filed: Apr. 21, 1980

Related U.S. Application Data

[60] Division of Ser. No. 934,773, Aug. 18, 1978, abandoned, which is a continuation-in-part of Ser. No. 853,068, Nov. 21, 1977, Pat. No. 4,160,297.

[51] Int. Cl.[3] ..... D06B 3/02

[52] U.S. Cl. ..... 68/158; 68/62; 68/181 R; 68/DIG. 5

[58] Field of Search ..... 68/DIG. 5, 27, 181 R, 68/44, 45, 20, 62, 158; 8/156; 162/60, 203, 207, 301

[56] References Cited

U.S. PATENT DOCUMENTS

| | | | |
|---|---|---|---|
| 899,440 | 9/1908 | Shuman et al. | 68/44 X |
| 2,356,285 | 8/1944 | Street | 68/22 R |
| 2,360,779 | 10/1944 | Lang et al. | 162/55 |
| 2,745,712 | 5/1956 | Burling et al. | 68/27 X |
| 3,608,340 | 9/1971 | Fleissner | 68/DIG. 5 |
| 3,806,405 | 4/1974 | Heidweiller | 68/44 X |
| 3,834,869 | 9/1974 | Ancelle et al. | 68/44 X |
| 3,857,261 | 12/1974 | Wilcox | 68/27 X |

FOREIGN PATENT DOCUMENTS

| | | | |
|---|---|---|---|
| 2121722 | 11/1972 | Fed. Rep. of Germany | 68/45 |
| 76401 | 11/1954 | Netherlands | 68/27 |

*Primary Examiner*—Philip R. Coe

*Attorney, Agent, or Firm*—Robert E. Krebs; Thomas J. McNaughton

[57] ABSTRACT

A machine and process for washing paper stock pulp and other vacuum-filterable materials includes a wash drum mounted in a tank. Two endless filter belts are trained to pass around the wash drum and through wash liquid contained in the tank. A mat of pulp is formed between the two endless filter belts and carried on the wash drum and through the tank for washing therein. Wash liquor is pulled by vacuum through the pulp mat as it travels under the drum thereby washing the pulp mat. After the pulp has been washed it is removed from between the two belts.

6 Claims, 3 Drawing Figures

TWIN BELT VACUUM WASHER

RELATED APPLICATION

This is a division of Application Ser. No. 934,773, filed Aug. 18, 1978, and now abandoned, which is in turn a continuation-in-part of Application Ser. No. 853,068, filed Nov. 21, 1977, and now U.S. Pat. No. 4,160,297.

BACKGROUND OF THE INVENTION

1. Field of the Invention

The present invention relates to machines for washing paper stock pulp and other vacuum-filterable materials.

2. State of the Art

According to various processes well-known in the paper making industry, paper stock pulp is formed by digesting wood chips in the presence of various chemicals in a heated pressure vessel. After discharge from the pressure vessel, the paper stock pulp must be washed and filetered to separate the wood fibers from the digested chemicals.

One system for washing paper stock pulp is taught in U.S. Pat. No. 2,355,243. According to that patent, paper stock is diluted with water after digestion and then is picked up by a large-diameter rotating cylinder whose surface is formed of a wire mesh screen. A couch roll is positioned to press downward onto the surface of the screen-covered cylinder to express liquid from the stock and thus to form a residual blanket or mat of dewatered fibers. The system described in the patent further includes an agitation device wherein once-dewatered fibers are repulped by mixing with water. Still further, the system taught in the patent includes additional agitation devices, screen-covered cylinders, and couch rolls to wash the pulp in stages.

According to other processes well-known in the paper-making industry, materials such as waste paper and groundwood, although not digested with chemicals, must nevertheless be washed. Also, the preparation and manufacture of other vacuum-filterable materials such as gold and uranium ores, sugar and phosphoric acid includes washing the materials with either water or chemicals. Conventional systems for washing such vacuum-filterable materials are known.

OBJECTS OF THE INVENTION

The primary object of the present invention is to provide an improved machine to wash paper stock pulp and other vacuum-filterable materials. As will be readily understood in view of the following description, the term vacuum-filterable encompasses materials which, when covering a filtering surface, allow liquid to pass therethrough when a pressure differential is applied. The term pulp is used herein as a synonym for vacuum-filterable materials.

A more specific object of the present invention is to provide an improved machine for washing pulp which operates without re-pulping of the pulp stock.

BRIEF DESCRIPTION OF THE DRAWINGS

The above and other objects of the present invention may be readily ascertained by consideration of the following detailed description and appended drawings, which are offered by way of illustration only and not in limitation of the invention, the scope of which is defined by the appended claims and equivalents.

In the drawings.

DETAILED DESCRIPTION OF THE INVENTION

Figure 1:
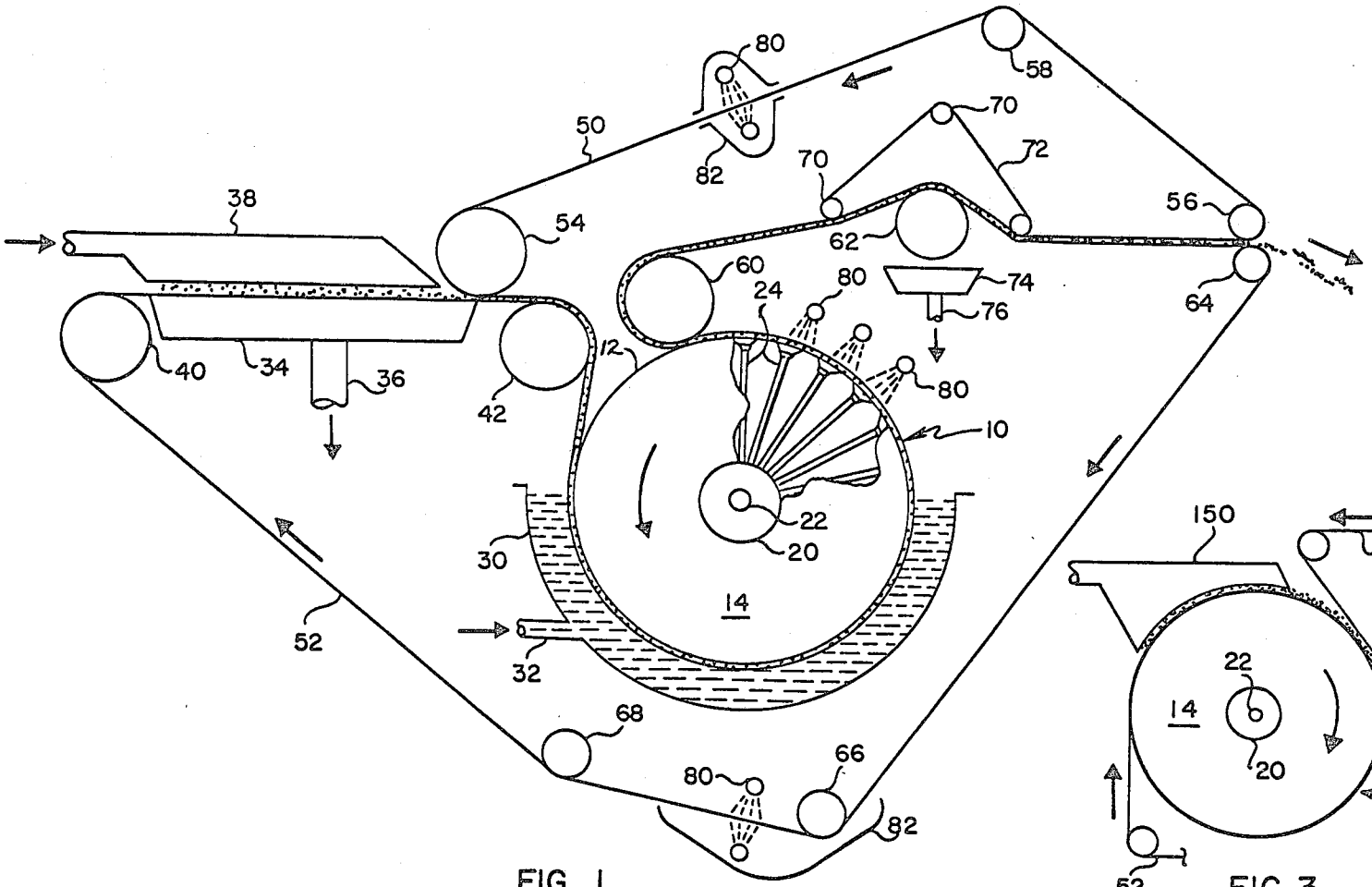
FIG. 1 is a side elevation of a machine according to the present invention shown schematically.

As shown in FIG. 1, a machine according to this invention includes a horizontally-disposed drum 10. The drum 10 includes a cylindrical sidewall 12 and end walls 14. The cylindrical sidewall is perforated, say by small spaced-apart apertures, not shown. Workers skilled in this art will readily recognize that the sidewall of the drum, instead of being perforated, could be comprised of a wedgewire grid or other conventional support means which permit liquid flow communication with the interior of the cylindrical sidewall 12. The illustrated end walls 14 are nonforaminate; however, in practice they can be perforated or the like to reduce their weight. Axle members, not shown, are fixed to the end walls 14, and are supported for rotation outboard of the drum by stationary pillow blocks or other journal means.

A rotary valve 20 with port 22 is formed in the axle member of the drum 10 in fluid-flow communication with radially-extending filtrate conduits 24 disposed within the drum 10. The conduits 24 are connected to the apertures in the sidewall 12. Such a structure is conventional. In operation, the rotary valve communicates with the conduits 24 to permit liquid to flow through the apertures in the sidewall 12 and thence from the drum via the port 22. In operation the port 22 is coupled to a vacuum means to apply vacuum to the apertures via conduits 24.

Referring still to FIG. 1, open tank 30 is mounted below the drum 10. The tank 30 is constructed and positioned to encompass approximately the lower half of the drum 10 and to contain a substantial quantity of liquid exterior of the drum. A liquid inlet means, such as a conduit 32 is connected in communication with the tank 30 to carry wash liquor thereinto. In some applications, the wash liquor may simply be fresh water while in other instances it may be aqueous solution of particular chemicals or non-aqueous solvent.

Figure 3:
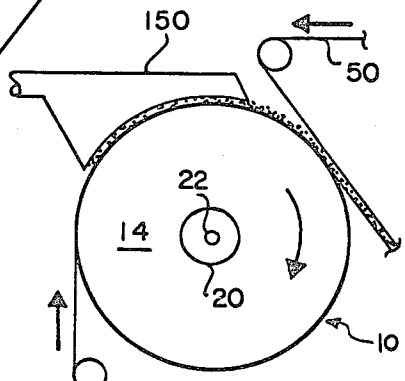
FIG. 3 is a side elevation which schematically illustrates another modification of a machine according to the present invention.
Figure 2:
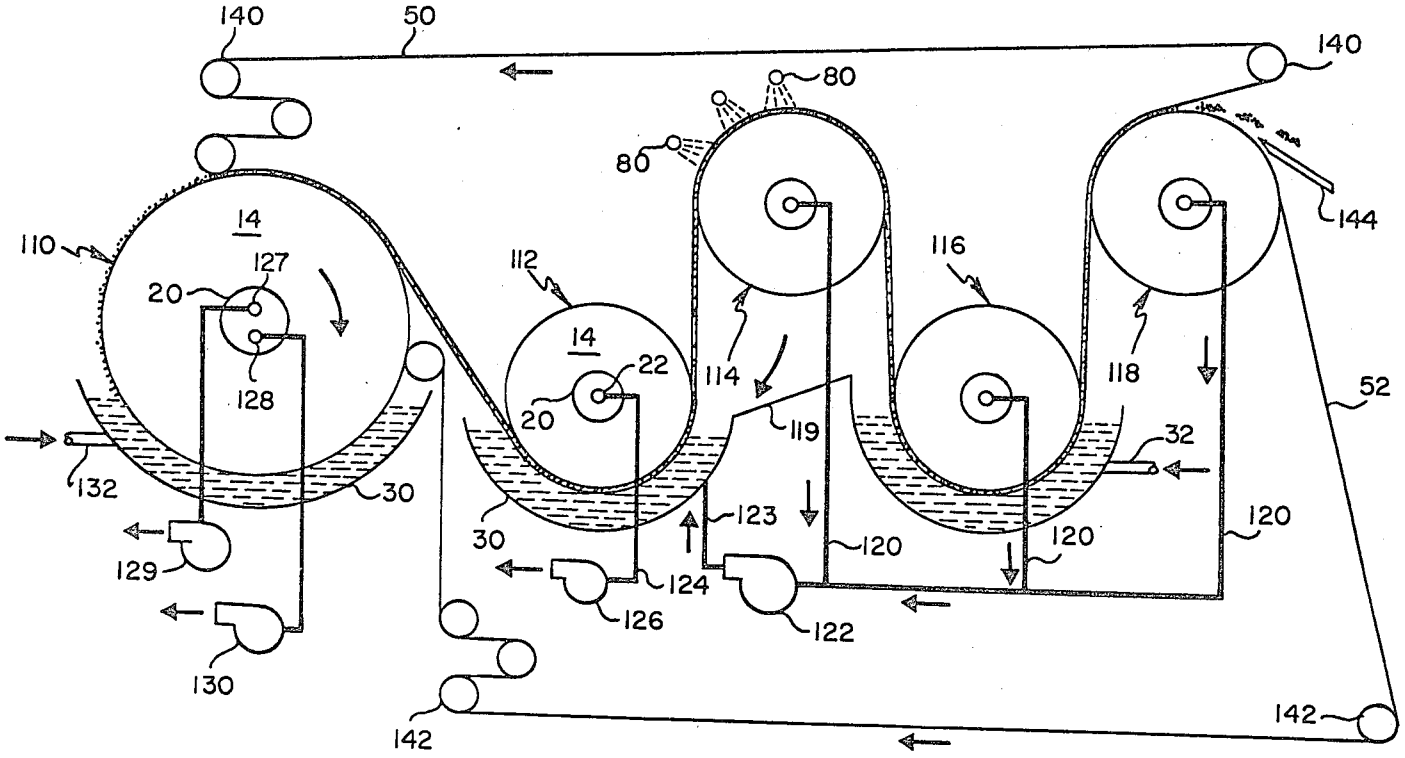
FIG. 2 is a side elevation which schematically illustrates a particular modification of a machine according to the present invention.

The machine in FIG. 1 further includes feed means which, in the illustrated embodiment by way of example, comprises a horizontal vacuum pan 34 of conventional construction which is mounted to the left of the drum 10. A conventional suction-producing device, not shown, is connected in communication with the interior of the vacuum pan to draw liquid therefrom via a conduit 36. Above the vacuum pan 34 is mounted a distribution box 38, which also can be understood to be of conventional construction. At the opposite ends of the vacuum pan are rotatably mounted support rollers 40 and 42. One skilled in this art should readily recognize that the feed means could, alternatively, comprise other conventional means for forming a pulp mat on a belt. For example, some forming means are illustrated in FIGS. 2 and 3 and discussed below.

Two endless filter belts 50 and 52, referred to herein as the upper and lower belts respectively, are trained around the drum 10 as illustrated in FIG. 1. More particularly, the endless belts are trained to pass around part of the drum 10 in face-to-face relationship to each other and to pass around a plurality of roller members. The endless belts should be understood to comprise conventional porous belts of the type which are well known in the filtration art, and the roller members are rigid, hollow cylinder disposed on bearings to rotate about their axes.

The upper belt 50 is trained around rollers 54–58; and the lower belt 52 is trained around rollers 40, 42 and 60–68. Conventional drive means, not shown, are connected to rotatably drive the drum 10 and, thus, to cause the two endless belts 50 and 52 to travel together at equal speeds in the directions indicated by the arrows in FIG. 1. Alternatively the drive means can be connected to drive a selected roller such as roller 40. The rollers 56 and 64 are positioned to separate the upper and lower belts after the belts have passed around the drum 10 and, at the opposite end of the machine, rollers 54 and 42 are located to reunite the belts in face-to-face relationship after the lower belt 52 travels between the distribution box 38 and vacuum pan 34. It should be understood that the position of roller 60 relative to the drum 10 can be adjusted to determine the extent to which the belts 50 and 52 wrap around the drum. In practice, at least one roller in both the upper and lower sets of belts is movably mounted so that the tensions of the belts can be selectively adjusted. Also, conventional means for laterally aligning the belts are normally provided.

In certain applications where a relatively dry pulp is desired, expression means are located between rollers 60 and 64 to express liquid from the pulp mat. In the illustrated embodiment the expression means includes three rollers 70 located in a triangular array adjacent roller 62. A third belt 72 is trained around the rollers 70 above the belts 50 and 52 where they traverse roller 62. The uppermost roller 70 can be positioned vertically to create a predetermined tension in the belt 72. This expression means is conventional and known alternatives can be employed to apply pressure to the pulp mat to express liquid therefrom. Collection trough 74 is disposed below roller 62 to collect liquid and carry it to disposal via line 76.

Conventional spray means can be utilized to clean the belts 50 and 52. The illustrated spray means include spray nozzles 80 located adjacent the upper belt 50 between rollers 54 and 58 and adjacent the lower belt 52 between rollers 66 and 68. Collection means 82 are located beneath the nozzles 80 to collect liquid.

Optionally, conventional spray means can also be utilized to wash the pulp. In the illustrated embodiment spray nozzles 81 are located adjacent the upper part of the drum to spray liquid onto the belts and the pulp mat.

The operation of the above-described machine can now be understood. Initially a vacuum-filterable material, such as paper stock containing digestion chemicals, is fed into the distribution box 38 as indicated by the arrow. That material is then discharged onto the belt 52 as it travels across the vacuum pan 34. Suction applied through the vacuum pan 34 draws liquid from the pulp, leaving a sheet or mat of partially dewatered pulp lying on the belt 52. The withdrawn liquid, or filtrate, is discharged from the machine. The lower belt 52, after passage across the vacuum pan, meets the upper belt 50 in face-to-face relationship and, thus, the mat of pulp is held between the two belts. Typically, the pulp mat is about one-quarter to one inch in thickness.

The two filter belts 50 and 52, with the pulp mat between them, then meet the drum 10 and pass into the tank 30. Simultaneously the drum 10 is rotated by a drive means, not shown. At this time vacuum is applied to the port 22 to apply vacuum to the interior of the pulp mat. The vacuum induces liquid to flow from the wash tank 30, through the pulp mat between the two belts, into the interior of the drum 10 and thence from the drum 10 through ports 22 and to a liquid receiving means. The flow of liquid through the pulp mat serves to wash the pulp and, in some instances, also increases the moisture content of the pulp mat because some of the wash liquid is absorbed by the pulp.

The two belts 50 and 52, after passing through the liquid in the tank 30 remain next to the drum 10 for a predetermined part of the rotation of the drum and exposed to the air. During this time the vacuum inside the drum pulls liquid from the pulp mat to dry the pulp. Optionally, additional liquid is sprayed onto the pulp mat at this time. Thereafter the belts leave the drum and travel over roller 60 and then between roller 62 and belt 70. During this stage, the pulp mat is squeezed between the belts due to the tension in the upper belt 70, and liquid is expressed from the pulp. Next, the upper and lower belts 50 and 52 are moved apart by the guide rollers 56 and 60 to expose the washed pulp mat. The pulp mat is then discharged from the machine by suitable means, not shown, such as a doctor blade or the like.

An embodiment of a particular modification of the aforedescribed machine will now be described in conjunction with FIGS. 2 and 3. In this embodiment, elements which are common to the machine in FIG. 1 are designated by the same reference numerals. This embodiment differs from the one described earlier principally with respect to the number and arrangement of the drums and tanks as well as with respect to the piping of the machine.

As shown in FIG. 2, a machine according to this embodiment includes five horizontally-disposed drums 110, 112, 114, 116 and 118 which are mounted in spaced-apart, side-by-side relationship. The five illustrated drums 110–118 are essentially the same in construction and operation as drum 10 shown in FIG. 1 and described above.

A plurality open tanks 30 are mounted one below each of the respective drums 110, 112 and 116. The tanks 30 associated with drums 112 and 116 are connected by an inclined plate 119 located beneath drum 114 so that liquid falling from the drum 114 falls onto the plate and flows into tank 30.

A liquid inlet means, such as a conduit 32 is connected in communication with the tank 30 associated with drum 116 to carry wash liquor into the tank. In some applications, the wash liquor may simply be fresh water while in other instances it may be a solution of particular chemicals. As will be understood in view of the following description, the flow of wash liquid is countercurrent to the direction of travel of pulp material through the machine.

Liquid-carrying means are coupled to the drums 114–118 to convey liquid therefrom into tank 30 associated with drum 112. In the illustrated embodiment the liquid-carrying means includes a plurality of pipes 120 coupled to the ports 22 of drums 114–118. The pipes 120 are coupled in fluid-flow communication to the inlet of vacuum pump 122, and the outlet of the vacuum pump is coupled via line 123 to tank 30 associated with drum 112. Liquid-carrying means including pipe 124 and vacuum pump 126 is coupled to drum 112 to produce a vacuum in the drum and convey liquid therefrom the disposal.

The rotary valve 20 of drum 110 includes two ports 127 and 128 coupled to pumps 129 and 130 respectively. The port 128 communicates with the apertures in the wall of the drum which are beneath the liquid. The port 127 communicates with the apertures above the liquid which are in contact with the pulp mat. Such a structure is a conventional means to permit the liquid from the tank to be kept separate from the liquid and air removed from the pulp above the liquid.

It should be understood that in certain applications vacuum means other than pumps are substituted for pumps 122, 126, 129 and 130. Some pulps contain chemicals which contain soap-like chemicals which foam when pumped. When such pulps are processed in the present system, conventional vacuum receiving means are substituted for the pumps. Conventional vacuum-receiving means for example, comprise a tank with a vacuum pump connected to its top, and liquid inlet means and discharge means connected near the bottom. Thereby the liquid is removed from the lower part of the tank after it has settled, and foaming is reduced or eliminated.

The machine in FIG. 2 further includes feed means which, in the illustrated embodiment by way of example, comprises tank 30 associated with drum 110 and inlet conduit 132 coupled to the tank.

According to FIG. 2 the two endless belts 50 and 52 are trained around the drums in zig-zag fashion. More particularly, the endless belts are trained to pass under the drums 112 and 116, and over drums 110, 114 and 118.

Above the machine, the upper belt 50 is trained around a set of rollers 140; below the machine, the lower belt 52 is trained around a set of rollers 142. Conventional drive means, not shown, are connected to rotatably drive at least one of the drums and, thus, to cause the two endless belts 50 and 52 to travel together at equal speeds in the directions indicated by the arrows in FIG. 2. The upper and lower sets of rollers are positioned to separate the upper and lower belts after the belts have passed under the drum 116 and, at the opposite end of the machine, to reunite the belts in face-to-face relationship against drum 110. It should be further observed that the lower set of rollers 142 is positioned so that the lower belt 52 passes around the portion of drum 110 beneath the surface of the liquid in the tank 30 associated with that drum. In practice, at least one roller in both the upper and lower sets is movably mounted so that the tensions of the belts can be selectively adjusted. The tensions need not be the same. In fact, the upper belt 50 is preferably at greater tension than the lower belt 52. This causes the compressive force on the pulp mat to be greater when the mat passes over the drums 114 and 118 than when it passes under the drums 112 and 116. This is advantageous because the pulp mat is "worked", i.e., compressed during its passage over the drum 114 and allowed to expand and absorb wash liquid when passing under the drums through the wash liquor. This working can be likened to wringing a sponge and then allowing it to expand to absorb more water.

The operation of the above-described machine can now be understood. Initially a vacuum-filterable material is fed into the tank 30 via conduit 132 as indicated by the arrow. Suction is applied through the drum 110 to pull the material onto the belt 52 and remove liquid from the pulp, thereby forming a sheet or mat of pulp on the belt 52. The withdrawn liquid, or filtrate, is discharged from the machine via pump 130. The belt 52 moves with the drum 110 out of the liquid and vacuum is still applied to the drum 110 to remove additional liquid from the pulp and hold the mat on the belt 52. The lower belt 52, after traversing a predetermined part of the drum 110, meets the upper belt 50 in face-to-face relationship and, thus, the mat of pulp fibers is gripped between the two belts.

The two belts 50 and 52, with the pulp mat between them, then pass into the first tank 30 and under the first drum 112. Simultaneously the drum 112 is rotated, say be frictional engagement with the upper belt 50. At this time, liquid from the first wash tank 30 passes through the pulp mat between the two belts and then flows into the interior of the first wash drum 112. This flow of liquid through the pulp mat occurs because of the differential in the pressure between the interior and exterior of the wash drum 11; the differential head is provided and sustained by the pump 126 which continuously draws liquid from the interior of the drum 112 by vacuum. The flow of liquid through the pulp mat serves to wash the pulp and, in some instances, also increases the moisture content of the pulp mat because some of the wash liquid is absorbed by the pulp.

This two belts 50 and 52, after passing under the drum 112, then pass over the drum 114. During this stage, vacuum is applied to the drum 114 by pump 122 to remove liquid from the pulp. Optional sprays 80 spray wash water onto the pulp to further wash it. Liquid falling from drum 114 is collected on the plate 119 and flows into tank 30.

After passage over the drum 114 the two endless belts 50 and 52 carry the pulp mat into the second tank 30 and then under the drum 116. During this stage, the pulp mat undergoes a second wash like the one described above. Next, the belts 50 and 52 are moved apart by the roller 140 and drum 118 to expose the washed pulp mat. Vacuum applied to drum 118 dries the pulp mat, which is then discharged from the machine by suitable means, such as a doctor blade 144 or the like.

It should now be apparent that a machine according to this invention can include more than two tank and drum combinations depending upon the number of stages of washing which are required for a particular application.

Turning now to FIG. 3, there is illustrated an alternative means of forming the pulp mat. The illustrated means includes a drum 10 which is the same in construction and operation as drum 10 shown in FIG. 1 and described above. Lower belt 52 is trained to cover approximately the upper half of the drum 10, and the upper belt 50 is located to meet the lower belt on the drum 10 about 90 degrees clockwise of the point of tangency of the lower belt 52 with the drum. A feed means 150 is conventional and is located adjacent the drum near the exposed surface of the belt 52. In operation, vacuum-filterable material is applied to the belt 52 through feed means 150 while a vacuum is maintained within the drum to remove water and form a pulp mat.

I claim:

1. A machine for washing paper stock pulp and other vacuum-filterable materials comprising:

a. first and second horizontally-disposed drums each having a sidewall through which liquid can pass, said drums being mounted for rotation about their horizontal axes and disposed in side-by-side relationship;

b. a third horizontally-disposed drum mounted for rotation about its horizontal axis and disposed between said first and second drums, said third drum being mounted higher than said first and second drums;

c. two tanks mounted to encompass at least the lower part of said first and second drums, said tanks being constructed to contain liquid exterior to said drums;

d. first and second endless filter belts trained to pass under said first and second drums and over said third drum in face-to-face relationship with each other to hold a mat of material to be washed;

e. feed means to deposit the vacuum-filterable material between said first and second endless filter belts;

f. a first set of roller means mounted above said drums to guide said first endless filter belt from said second drum to said first drum, and a second set of roller means mounted below said drums to guide said second endless filter belt from said second drum to said first drum;

g. drive means mounted to drive said first and second endless belts;

h. liquid inlet means to introduce liquid into said tanks associated with said first and second drums; and, i. vacuum means connected in communication with said first and second drums to provide a pressure differential between the mat of material held between said first and second endless belts and the liquid contents of the associated said tanks thereby to force liquid from the tanks through the material, wherein said liquid inlet means includes means coupled to said vacuum means associated with said second drum to transfer the liquid removed from said second drum into said tank associated with said first drum.

2. A machine according to claim 1 further including means connected in communication with said third drum to provide a pressure differential between the mat of pulp and the exterior of said drum.

3. A machine according to claim 1 wherein said first belt is constructed and located so that it is at greater tension than said second belt so that a greater compressive force is exerted upon the material held between said belts when said belts pass over said third drum than when said belts pass under said first and second drums.

4. A machine for washing paper stock pulp and other vacuum-filterable materials comprising:

a. first and second horizontally-disposed drums each having a sidewall through which liquid can pass, said drums being mounted for rotation about their horizontal axes and disposed in side-by-side relationship;

b. a third horizontally-disposed drum mounted for rotation about its horizontal axis and disposed between said first and second drums, said third drum being mounted higher than said first and second drums;

c. two tanks mounted to encompass at least the lower parts of said first and second drums, said tanks being constructed to contain liquid exterior to said drums;

d. first and second endless filter belts trained to pass under said first and second drums and over said third drum in face-to-face relationship with each other to hold a mat of material to be washed;

e. feed means to deposit the vacuum-filterable material between said first and second endless filter belts;

f. a first set of roller means mounted above said drums to guide said first endless filter belt from said second drum to said first drum, and a second set of roller means mounted below said drums to guide said second endless filter belt from said second drum to said first drum;

g. drive means mounted to drive said first and second endless belts;

h. liquid inlet means to introduce liquid into said tank associated with said second drum;

i. means connected in communication with said first and second drums to provide a pressure differential between the mat of material held between said first and second endless belts and the liquid contents of the associated said tanks thereby to force liquid from the tanks through the material; and, j. means connected to said second drum to convey liquid from the interior of said second drum to said tank associated with said first drum.

5. A machine according to claim 4 wherein said third drum has a sidewall through which liquid can pass and including means connected in communication with said third drum to provide a pressure differential between the mat of pulp and the exterior of said drum.

6. A machine according to claim 4 wherein said first belt is constructed and located so that it is at greater tension than said second belt so that a greater compressive force is exerted upon the material held between said belts when said belts pass over said third drum than when said belts pass under said first and second drums.

* * * * *